US010051951B2

(12) United States Patent
Jun

(10) Patent No.: US 10,051,951 B2
(45) Date of Patent: Aug. 21, 2018

(54) CROCHET BOTTLE BRUSH AND HANDLE AND METHOD OF ASSEMBLY

(71) Applicant: Hanna Jun, Mercer Island, WA (US)

(72) Inventor: Hanna Jun, Mercer Island, WA (US)

(73) Assignee: Open Arms Holding, Bellevue, WA (US)

( * ) Notice: Subject to any disclaimer, the term of this patent is extended or adjusted under 35 U.S.C. 154(b) by 297 days.

(21) Appl. No.: 15/163,903

(22) Filed: May 25, 2016

(65) Prior Publication Data

US 2017/0340097 A1 Nov. 30, 2017

(51) Int. Cl.

| | |
|---|---|
| ***B08B 9/087*** | (2006.01) |
| ***A47L 17/00*** | (2006.01) |
| ***A46D 3/00*** | (2006.01) |
| ***A46B 9/00*** | (2006.01) |
| ***B08B 9/08*** | (2006.01) |
| *A47L 25/12* | (2006.01) |

(52) U.S. Cl.

CPC ..... *A46B 9/005* (2013.01); *A46D 3/00* (2013.01); *A47L 17/00* (2013.01); *B08B 9/0808* (2013.01); *A46B 2200/3006* (2013.01); *A47L 25/12* (2013.01)

(58) Field of Classification Search

CPC ..... A47L 17/04; A47L 17/06; A47L 17/08; A47L 25/12; B08B 9/0808; B08B 9/087; B08B 9/36; A46B 2200/3006; A46B 2200/3013; A46B 9/00; A46B 9/005

USPC ..... 15/164, 211, 223–226, 229.11, 229.13, 15/244.1, 244.3

See application file for complete search history.

(56) References Cited

U.S. PATENT DOCUMENTS

| | | | | |
|---|---|---|---|---|
| 510,791 | A * | 12/1893 | Hotham | 15/211 |
| 2,846,708 | A * | 8/1958 | Vosbikian | A47L 13/16 15/211 |
| 3,231,921 | A * | 2/1966 | Cuervo | A47L 17/00 15/211 |
| 3,571,837 | A | 3/1971 | Weaver | |
| 3,862,461 | A | 1/1975 | Bucklitzsch | |
| 5,214,820 | A | 6/1993 | Shumway | |
| 5,687,447 | A | 11/1997 | Bynum | |
| 6,453,503 | B1 | 9/2002 | Chen | |
| 7,044,560 | B1 | 5/2006 | Miller | |

* cited by examiner

*Primary Examiner* — Mark Spisich
(74) *Attorney, Agent, or Firm* — Donald S Debelak

(57) ABSTRACT

A bottle brush cleaning implement that uses a crochet scrubber component and an integrated handle and its method of assembly. The preferred embodiment of the crochet component has four brushes that are constructed out of one piece of crochet material that is attached and is held in place with a pronged holder with resistance barbs. The crochet component is additionally held in place by extra yarn that is attached to the bottom of the crochet scrubber and tied to the handle. The preferred embodiment's handle has a grip area with a series of round protrusions to improve handling. The bottle brush may be produced on a wide variety of shapes, colors, sizes and configurations to meet specific needs or individual preferences.

13 Claims, 12 Drawing Sheets

CROCHET BOTTLE BRUSH AND HANDLE AND METHOD OF ASSEMBLY

RELATED PATENT APPLICATIONS

Ser. No. 29/554,367 Crochet Bottle Brush with One Brush—Design Patent Application Ser. No. 29/544,399 Crochet Bottle Brush with Four Brushes—Design Patent Application

BACKGROUND—PRIOR ART

U.S. Patents

| Pat. No. | Kind Code | Issue Date | Patentee |
|---|---|---|---|
| U.S. Pat. No. 3,571,837 | A | 1971 Mar. 23 | Alexander Earl Weaver |
| U.S. Pat. No. 3,862,461 | A | 1975 Jan. 28 | Hans H. Bucklitzsch |
| U.S. Pat. No. 5,214,820 | A | 1993 Jun. 01 | Craig S. and Amy Shumway |
| U.S. Pat. No. 5,687,447 | A | 1997 Nov. 18 | Cheryl and Bart L. Bynum |
| U.S. Pat. No. 6,453,503 | B1 | 2002 Sep. 24 | Ching-Chen Chen |
| U.S. Pat. No. 7,044,560 | B1 | 2006 May 16 | Julie L and James Miller |

1. Field of the Invention

The present invention relates generally bottle washing scrubbers that are made of crochet material.

2. Background of the Invention Field

Crochet scrubbers (often referred to as crochet scrubbies) have been used for years for a variety of reasons, they can clean surfaces without scratching them, which is plus for cleaning products like non-stick pans. Crochet scrubbers also provide a soft surface for cleaning people's faces. Crochet scrubbers have been made by people for many years and are well known to many people. Bottle brush cleaners are often harsh bristles which can damage the inside of bottles or the bristles are thin which fall out or bend as the bristles do not have enough scrubbing power. Other bottle washers are made of foam or cloth which often don't have enough scrubbing power to be effective. A crochet scrubber attached to a handle has sufficient power to clean bottles while not damaging them. Crochet scrubbers as they exist in the market today present several problems for bottle washing as no one previously has established a way to mount the crochet scrubbers on a handle or stick. The searches conducted related to this invention found that none of the crochet scrubbers available today, and there are hundreds of them, are mounted permanently on a handle. Some crochet scrubbers have been constructed somewhat like a finger puppet so that they can go over a spoon or stick but they then can easily fall off the spoon or stick and then the spoon or stick may damage the surface.

DESCRIPTION OF PRIOR ART

Prior art descriptions are listed below.

1. Cloth based scrubbing brushes with handle. U.S. Pat. No. 3,571,837 is a patent with a removable scrubbing cloth that can be cleaned. This handle is not specifically made for a bottle, and it also uses a cloth rather than a crochet scrubber as its cleaning element.
2. Bottle Brushes with handle, which come in a wide variety of assorted shapes and materials and handles. U.S. Pat. No. 3,862,461 is an example of one such product, although there are many varieties of similar. U.S. Pat. No. 5,214,820 is another example of a dish cleaner with a handle. In both cases the handles are straight with the cleaning material glued on to the handle. Neither of these scrubbers are crochet scrubbers.
3. Handles for scrubbers with loops in the end. U.S. Pat. No. 5,687,447 and U.S. Pat. No. 6,453,503 are examples of the loops in the end through which scrubbing devices of many varieties are pushed through the loops to be held in place. Foam, cloth and other scrubbing materials are a sample of material held in place with a loop or hole of some type at the end of the handle. The device being proposed for a patent here does not use the loop or hole at the end of the handle for holding the cleaning material, but rather for hanging the bottle brush on a hook. This invention also uses a crochet scrubber which is not listed in any of these patents nor have the inventors nor patent agent been able to find any that have been sold commercially.
4. Other mesh type devices that are not crochet. U.S. Pat. No. 7,044,560 is a non-abrasive mesh made from tulle netting fabric and not crochet material and is not on a stick. Its configuration is mostly flaps of material rather than a one crochet piece of material.
5. Different types of handles to hold scrubbing devices. U.S. Pat. No. 7,469,442 is a sample of these type of products. None of the handles we could located used the prongs similar to the device listed herein or resistance barbs similar to the ones listed herein.
6. Crochet pieces that go on top of a handle or stick but are not attached. Though the no patents were discovered on such an arrangement there are commercially available a small number of crochet scrubbers designed to go over a spoon, handle or other device to clean bottles. None of these devices have the scrubber and handle permanently attached.

SUMMARY OF THE INVENTION

Crochet Bottle Brush and Handle

The Crochet Bottle Brush and Handle of this invention has several features, with no one single feature alone responsible for the invention's desirable attributes. Without limiting the scope of the invention that will be described in the claims, prominent features will be discussed. The preferred embodiment of the crochet component has four brushes that are constructed out of one piece of crochet material that is attached and is held in place with a pronged holder with resistance barbs. The crochet component is additionally held in place by extra yarn that is attached to the bottom of the scrubber and tied to the shaft. The preferred embodiment's handle has a grip area with a series of round protrusions to improve grip area friction. The bottle brush may be produced on a wide variety of shapes, colors, sizes and configurations to meet specific needs or individual preferences.

Method of Assembly

The starting point is a rectangular crochet scrubber that is two crochet stitches thick. One of scrubber's ends is folded over into the middle of the scrubber. Then the other end is folded the opposite direction with the end in the middle making two loops so that now the rectangular scrubber now looking like a figure eight. The ends that have been positioned in the middle are then lightly crochet into the middle of the crochet scrubber. The two middle of the loops of the figure eights are then pressed into the middle of crochet scrubber forming a four adjacent somewhat circular cylinders. The four cylinders are sewn together to make the shape of the crochet bottle brush described herein. The four cylinder bottle brush then is placed over the two prongs with resistance barbs that come out in a "U" shape from a handle. The four cylinders brushes come down the prongs and rest on the top of the handle prior to the prongs splitting off the handle. Yarn interwoven into a cone shape and place under the four cylinder brushes is then fastened to the handle with a thread or other tying device.

In additional embodiments the four cylinders brushes will be tied in the middle of the brush to the handle.

In additional embodiments the scrubber section will be more of less than two crochet stitches thick.

In additional embodiments the bottle brush will have two cylindrical brushes.

In additional embodiments the prongs will have not have resistance barbs.

In additional embodiments the handle will have four prongs.

In additional embodiments the prongs will act like a peg by squeezing and holding the crochet brush scrubber in place.

In additional embodiments the prongs will hold the crochet brush scrubber from the outside.

In additional embodiments the handle will have a different configuration in the gripping area.

In additional embodiments the handle will be extendable.

Advantages of the Invention

The most prominent advantages of the invention are:

1. The crochet bottle brush provides a suitable scrubber that can adequately clean the insides of bottles without harming the inside surface;
2. Is configured to allow the use of crochet scrubber that is attached to a handle;
3. The crochet brush scrubber is strong and durable so as not to fall apart or tear.

DRAWINGS—FIGURES

REFERENCE NUMBERS

1. Yarn fuzz.
2. Crochet piece of the scrubber.
3. Yarn attached to bottom of scrubber.
4. Prongs that hold the scrubber onto the handle.
5. Resistance barbs on prongs.
6. Handle.
7. Point where handle connects to the prongs.
8. Hand grip section of handle.
9. Hole at the end of handle.
10. String type material attaching the yarn to the bottle brush.
11. Tying mechanism for the string material that attaches the tarn to the bottle brush.

DETAILED DESCRIPTION OF THE INVENTION

Figure 1:
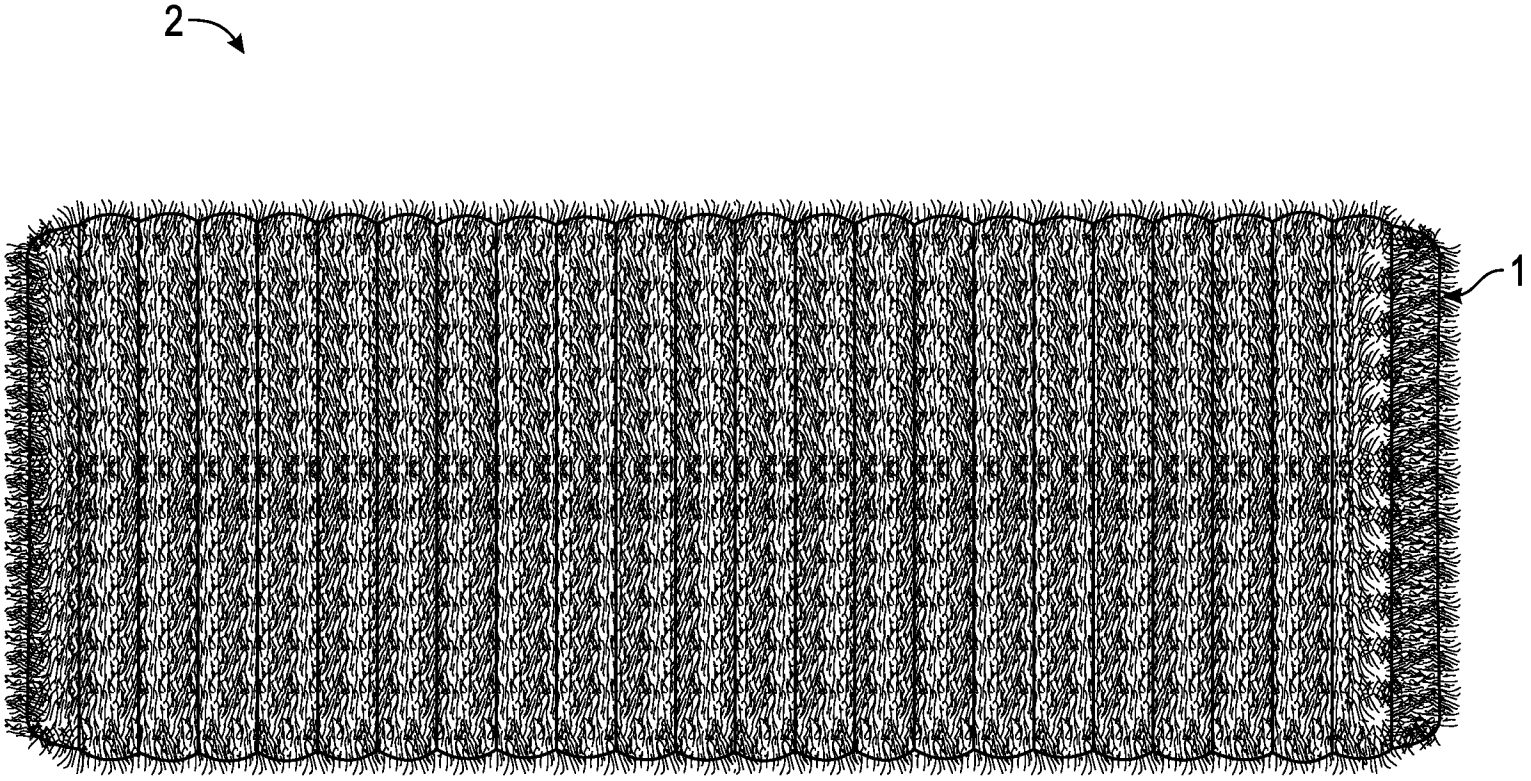
FIG. 1 is the drawing of the starting piece of crochet material.
Figure 2:
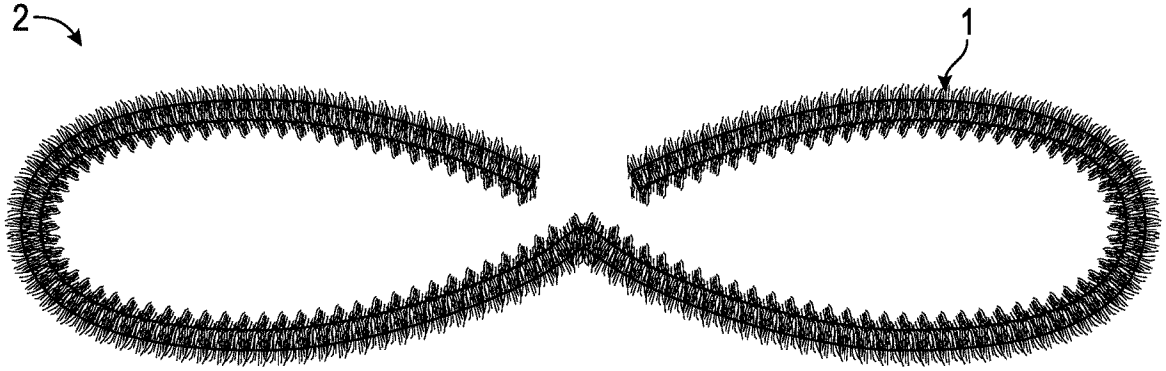
FIG. 2 is a top view of the starting piece as if comes together to form two loop.
Figure 3A:
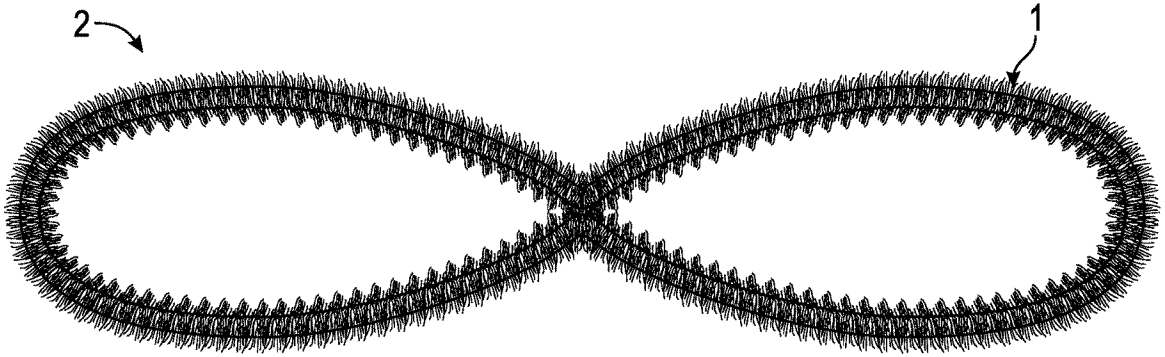
FIG. 3A is a top view showing how the two loops are tied together in the center.
Figure 3B:
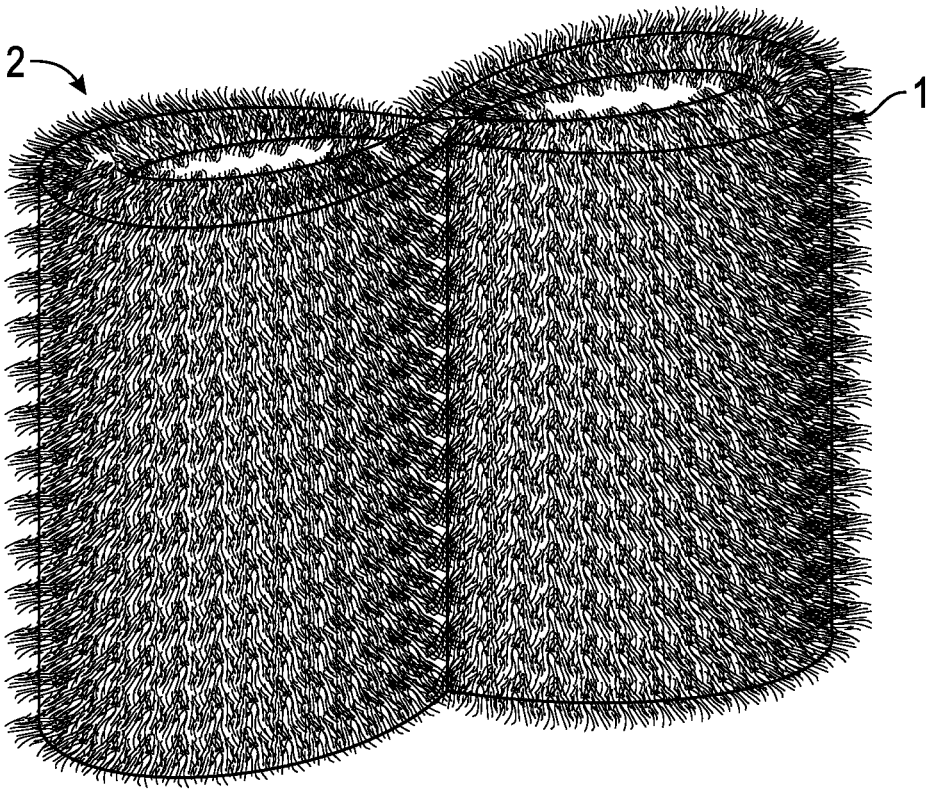
FIG. 3B is a side view of crochet material tied together into two loops.
Figure 4:
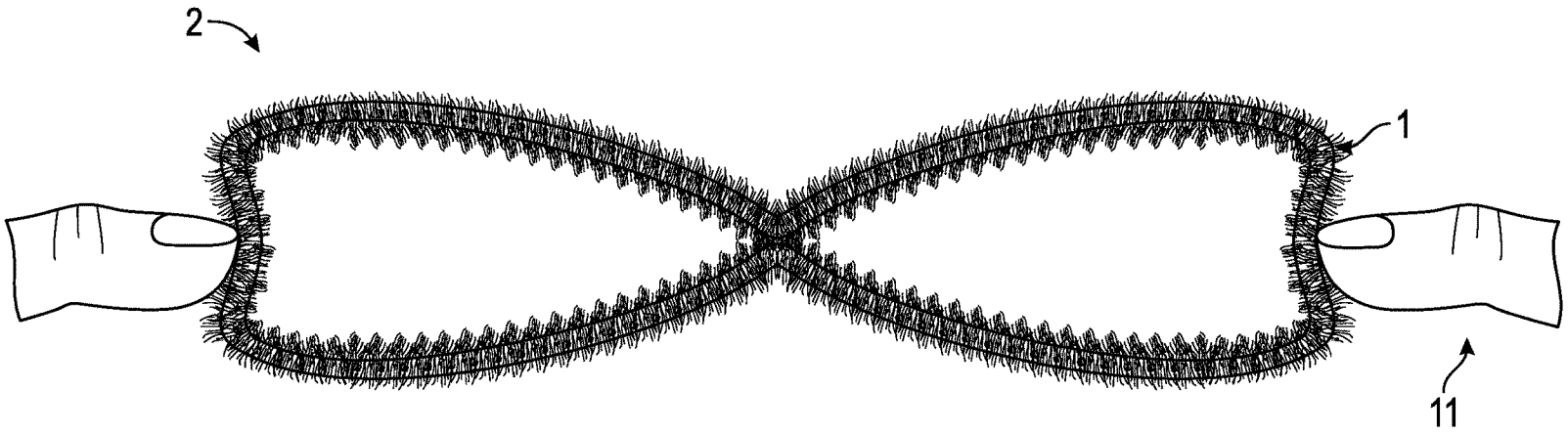
FIG. 4 shows the starting point of the two loops being converted to four loops.
Figure 5A:
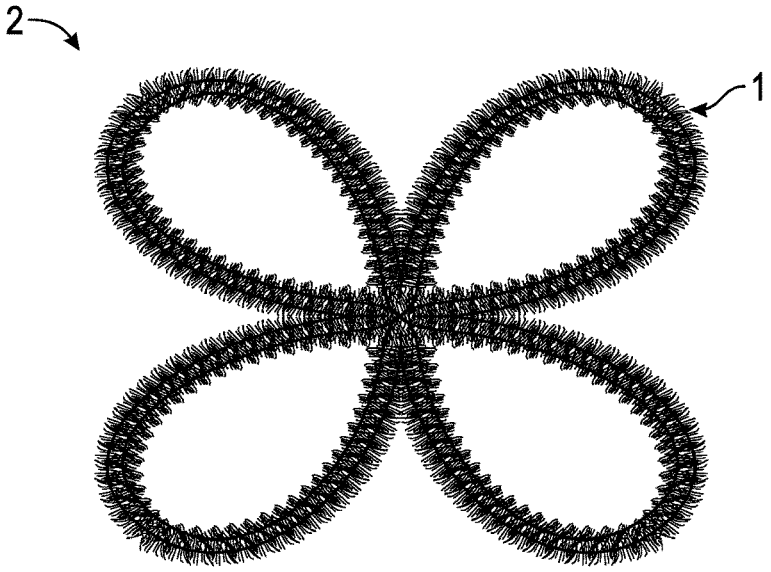
FIG. 5A is a top view of the four loops brought together and tied making the four brush crochet section of the bottle brush.
Figure 5B:
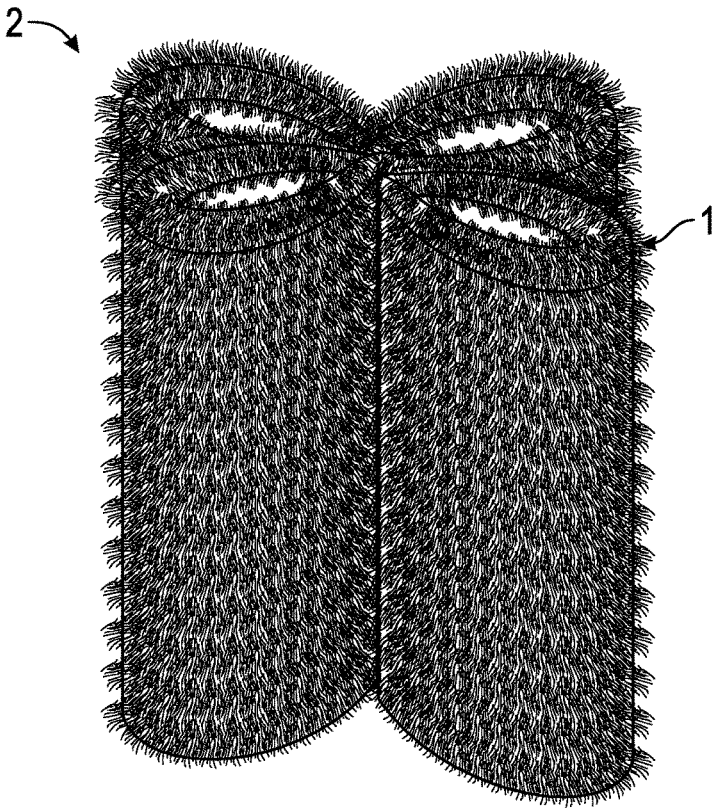
FIG. 5B is a side view of the four brush section of the crochet bottle brush.
Figure 6A:
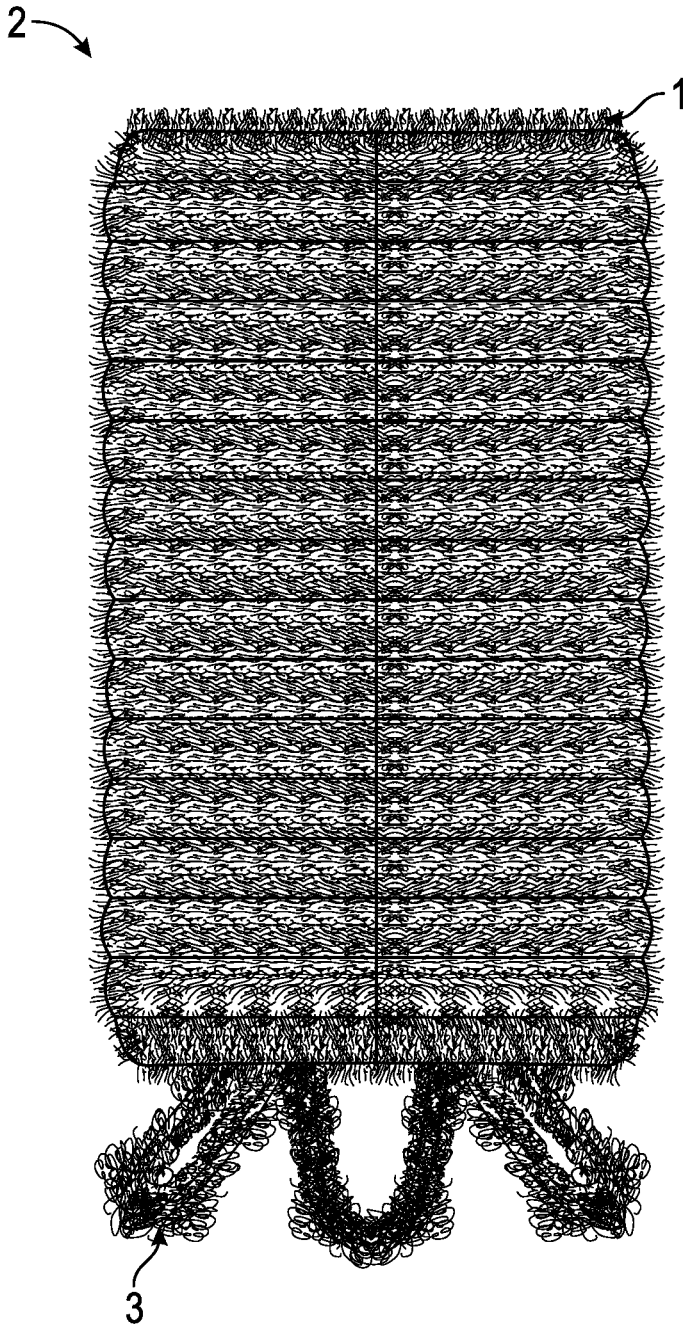
FIG. 6A is a view of the extra yarn attached to the bottom of the four brushes to hold the brush in place on the bottle brush.
Figure 6B:
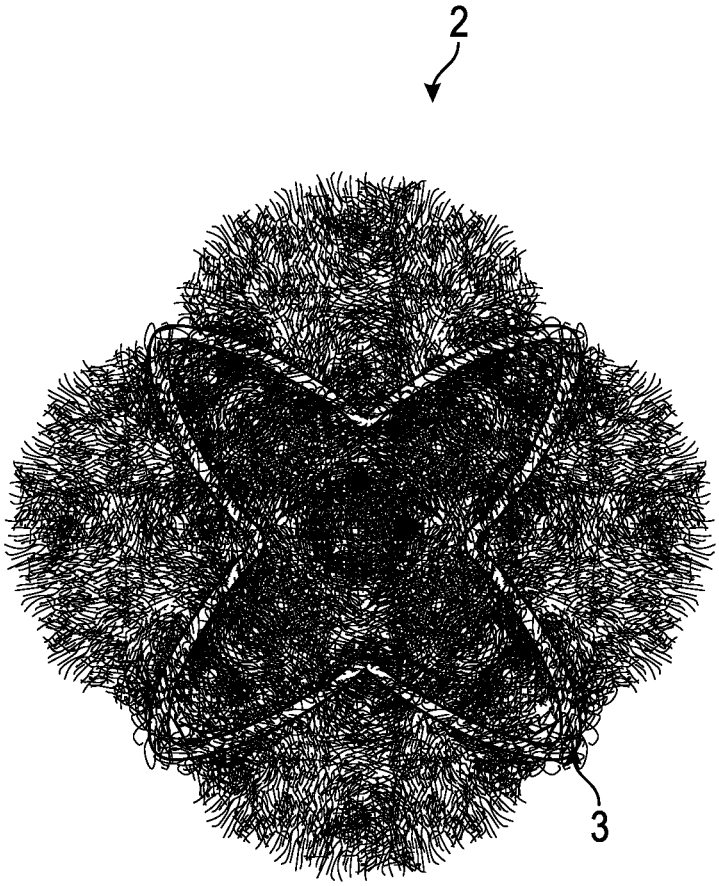
FIG. 6B is a bottom view of bottom of the bottle brush showing how the yarn is attached to the bottle brush.
Figure 7:
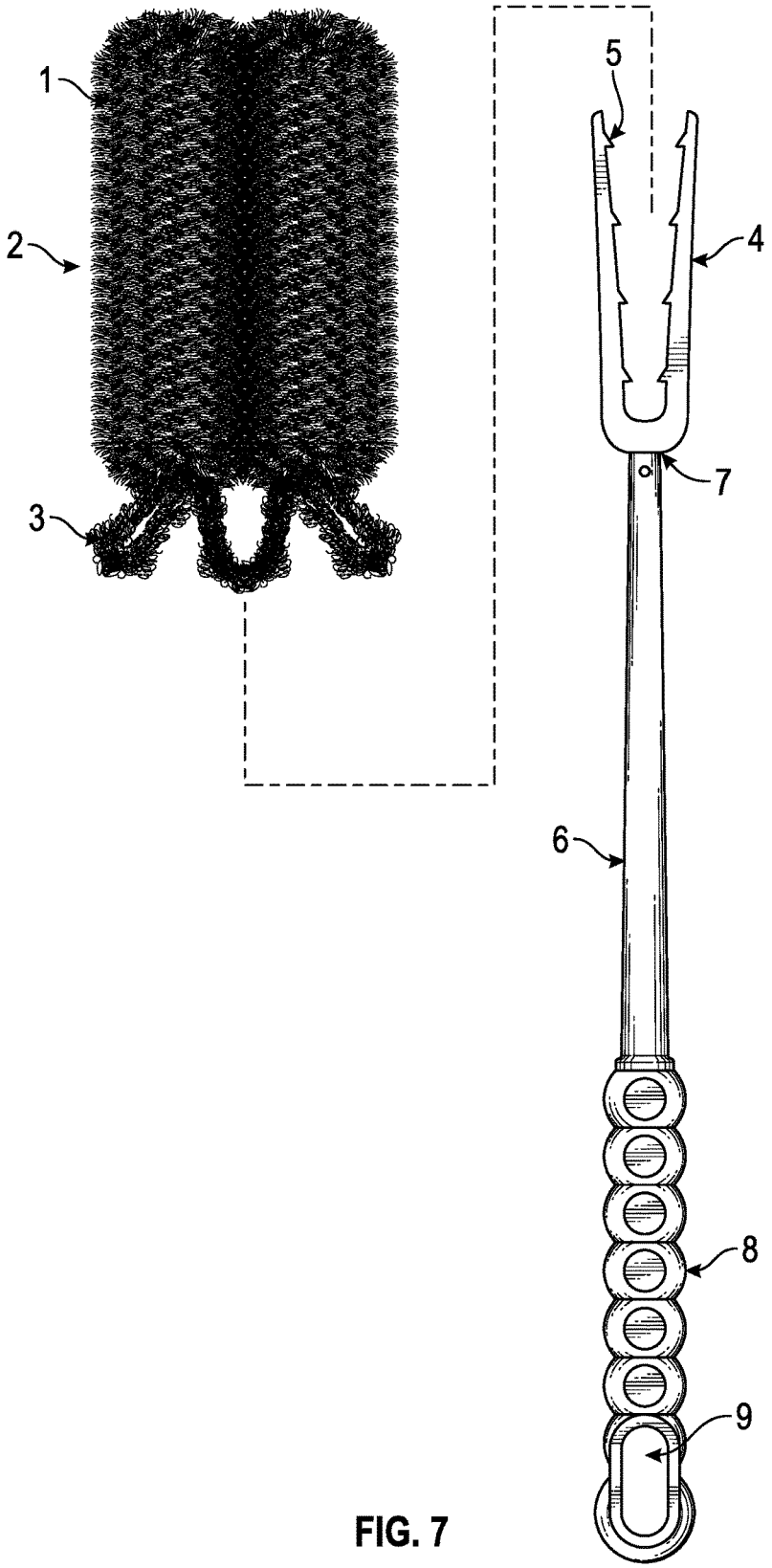
FIG. 7 shows the bottle brush handle from the side with its two prongs that hold the crochet part of the bottle brush and the barb hooks that hold it in place.
Figure 8:
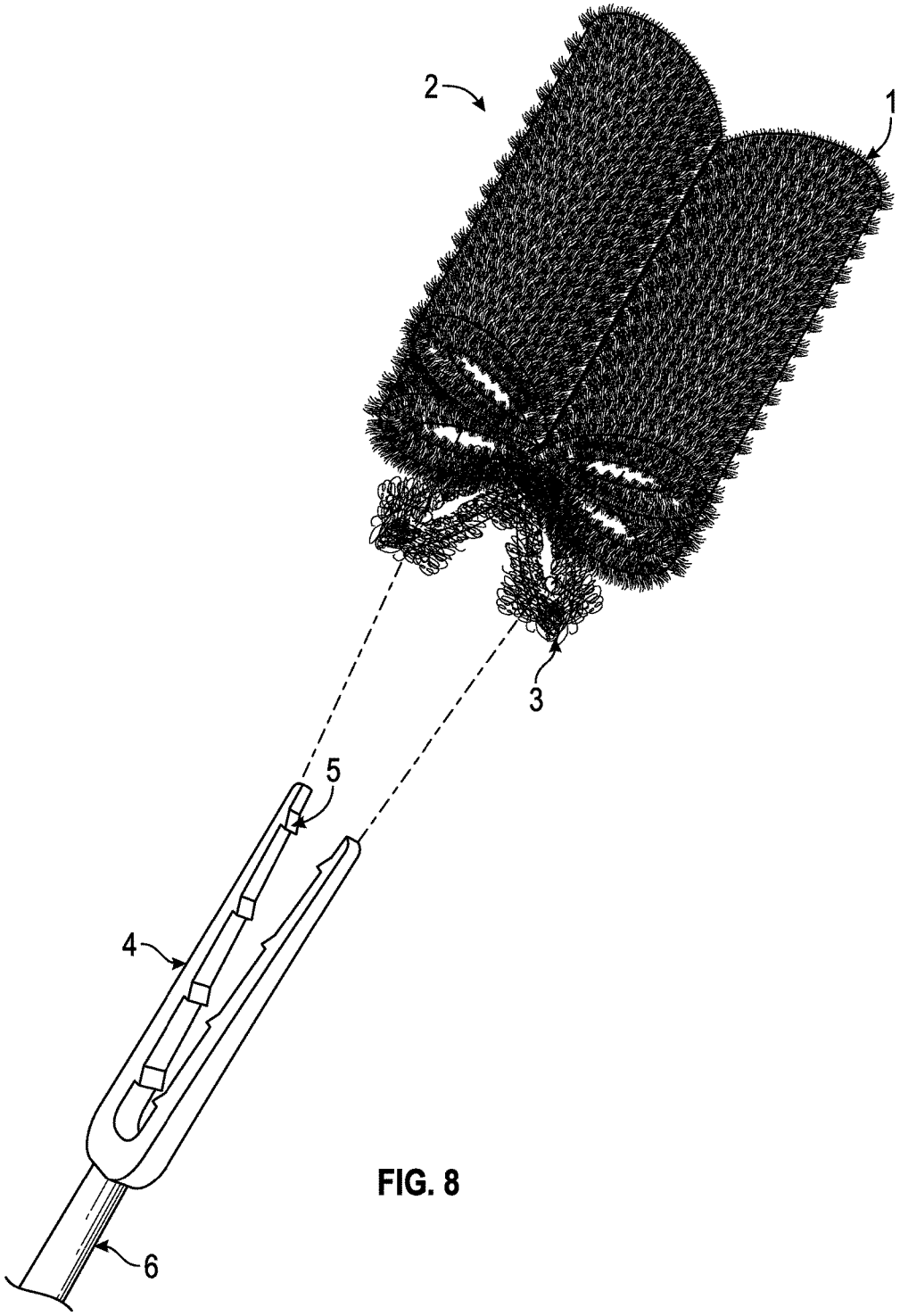
FIG. 8 shows how the crochet part of the bottle brush goes over the two prongs of the handle.
Figure 9:
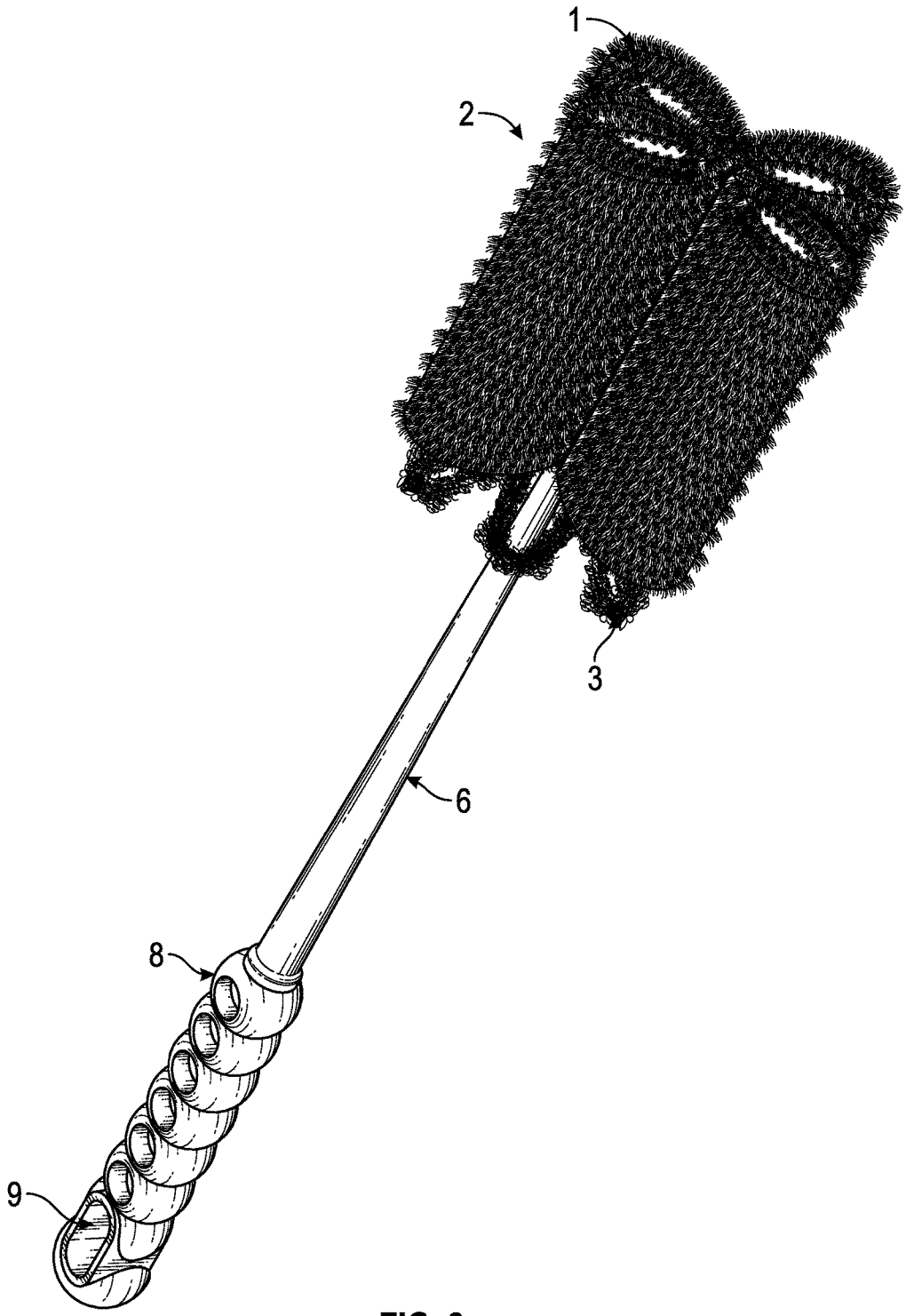
FIG. 9 shows how the bottle brush initially fits over the handle.
Figure 10:
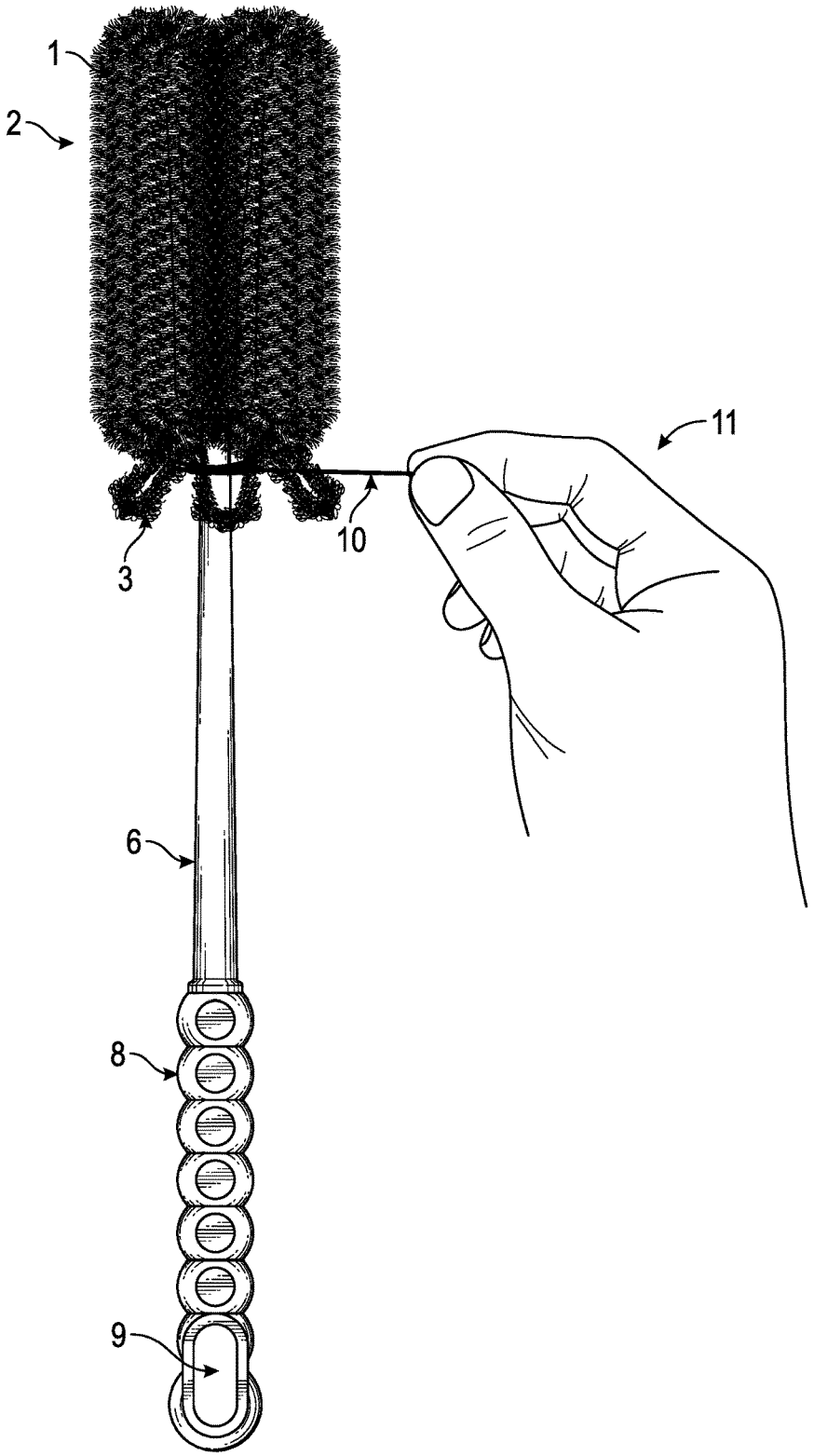
FIG. 10 shows how the yarn on the bottom of the bottle brush is tied onto the handle.
Figure 11:
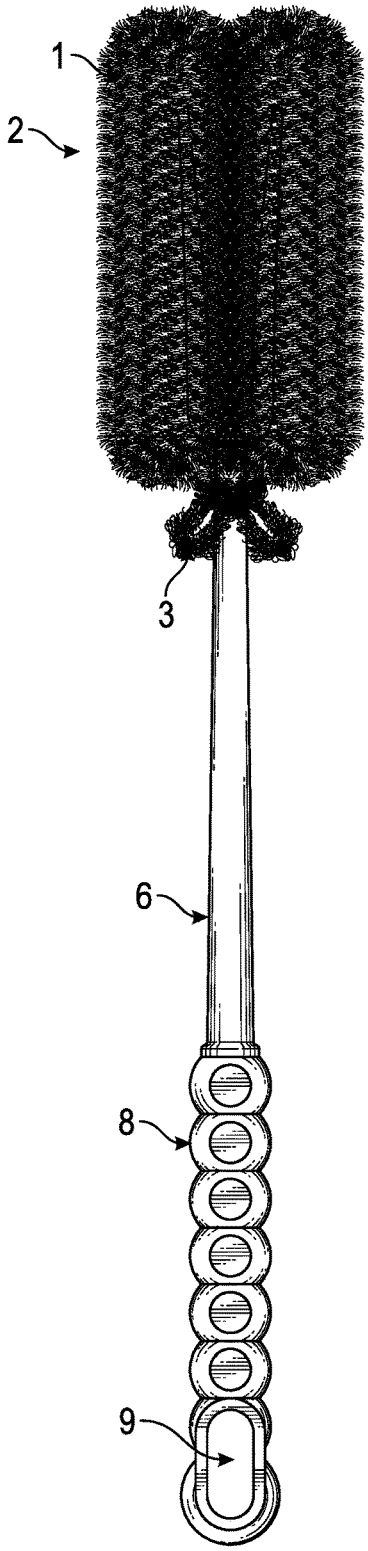
FIG. 11 shows the completed four brush bottle brush.

The drawings present the preferred embodiment of the invention. Variations in each of the components is possible and mentioned in some of the additional embodiments listed in the SUMMARY OF THE INVENTION SECTION. FIG. 1 is the crochet piece of the scrubber 2 of the invention prior to it being formed into four brushes. The lines on FIG. 1 are for the crochet stitch line of the invention. Yarn fuzz 1 extends past the crochet stitch lines which plays an important role in the scrubber action. FIG. 2 shows that the scrubber section is two stitch lines thick, which is the preferred embodiment. FIG. 2 also shows how the crochet piece of the scrubber 2 is brought together to form a double loop in the method that produces the final four brush configuration. FIG. 3A shows where the ends of the crochet piece of the scrubber 2 are attached so the double loop configuration is permanent. FIG. 3B is a stand up view of the crochet piece of the scrubber in its double loop configuration. FIG. 4 shows the starting point of the process of converting the crochet piece of the scrubber 2 from a two loop to a four loop configuration. In this figure fingers are shown starting the conversion from a two loop to four loop configuration but this could also be done with a machine. FIG. 5A shows from the top of the crochet piece of the scrubber 2 positioned and attached into a permanent four loop configuration. FIG. 5B shows the crochet piece of the scrubber 2 configured into a four loop configuration from a side view. FIG. 6A shows yarn 3 that is attached to the bottom the crochet piece of the scrubber 2. FIG. 6 B shows the crochet piece of the scrubber 2 from the bottom how the yarn 3 is attached. FIG. 7 shows the handle that the crochet piece of the scrubber 2 with attached yarn 3 goes over. The overall handle consists of a two prong section 4 with resistance barbs 5. The two prong section is attached to the remainder of the handle 6 at an attachment point 7. The handle 6 also has a grip section 8 and a hole at the end of the handle 9. FIG. 8 shows how the crochet piece of the scrubber 2 fits over the two prongs 4 with resistance barbs 5. FIG. 9 show the bottle brush complete with the exception of the yarn 3 being tied to better hold the crochet scrubber piece of the bottle brush in place. FIG. 10 shows the string type material 10 attaching the yarn 3 on the bottom of the crochet piece of the scrubber 2 by a means of tying 11. The drawings show a hand as 11, but it could also be a machine. FIG. 11 shows the completed bottle brush.

I claim:

1. A crochet scrubber brush and handle comprising:

a. a scrubber formed of a crochet material defining four elongate tubular scrubber brushes each extending from a central portion of the scrubber;

b. a handle;

c. at least two prongs in a "U" shape attached to the handle;

d. the prongs each having multiple resistance barbs;

e. a piece of fabric attached to a bottom of the tubular scrubber brushes; and f. the piece of fabric is held on the handle with a tying device.

2. The device of claim 1 where the handle has a gripping area with a different surface than the rest of the handle.

3. The device of claim 2 with the handle having a different configuration in the gripping area.

4. The device of claim 1 wherein the four tubular scrubber brushes are tied in the middle of the brush to the handle.

5. The device of claim 1 wherein the handle having four prongs.

6. The device of claim 1 with the prongs squeezing and holding the four scrubber brushes in place.

7. The device of claim 1 with the prongs holding the four crochet scrubber brushes from the outside.

8. The device of claim 1 with the handle being extendable.

9. The device of claim 1 wherein the fabric is comprised of yarn.

10. A method of constructing a bottle brush with a crochet scrubber comprised of:

a. a rectangular crochet scrubber with the length greater than height;

b. one of scrubber's ends is folded over into the middle of the scrubber;

c. the other end is folded the opposite direction with the end in an area near the middle of the scrubber, whereby the rectangular scrubber now has two loops looking like a figure eight;

d. The ends that have been positioned in the area near the middle are then crochet into the area near the middle of the crochet scrubber;

e. A point approximately at the midpoint of one of the loops is then pressed into the area of the middle of crochet scrubber;

f. A point approximately at the midpoint of the other loop is then pressed into the area of the middle of the crochet scrubber;

whereby a shape of four adjacent cylinders is made;

g. Providing a handle with at least two prongs defining a "U" shape at the end of the handle, the prongs each having multiple resistance barbs;

h. The four cylinders are sewn together;

i. The handle's two prongs are inserted into the four cylinders of the crochet scrubber;

j. the four cylinders of the crochet scrubber come down over the prongs and rest on the top of the handle prior to the prongs splitting off the handle;

k. a piece of fabric is shaped into a cone and placed under the four cylindrical brushes; and l. the piece of fabric is fastened to the handle with a tying device.

11. The method of claim 10 wherein the cylinders are tied with a tying device to the handle approximately halfway between the top and bottom of the crochet scrubber.

12. The method of claim 10 wherein the fabric is comprised of yarn.

13. The method of claim 10 wherein the tying device is thread.

* * * * *